US008236064B2

(12) United States Patent
Hendel et al.

(10) Patent No.: US 8,236,064 B2
(45) Date of Patent: Aug. 7, 2012

(54) METHOD OF PRODUCING SAFETY TEXTILES IN ONE OF THE COLORS FLUORESCENT YELLOW, ORANGE-RED AND FLUORESCENT RED

(75) Inventors: Rainer Hendel, Bischberg/Trosdorf (DE); Sven Klaus Brosig, Helmbrechts (DE)

(73) Assignee: Hendel Textilveredelung GmbH, Hallstadt (DE)

( * ) Notice: Subject to any disclaimer, the term of this patent is extended or adjusted under 35 U.S.C. 154(b) by 680 days.

(21) Appl. No.: 12/311,611

(22) PCT Filed: Oct. 12, 2007

(86) PCT No.: PCT/EP2007/060877

§ 371 (c)(1),
(2), (4) Date: Apr. 6, 2009

(87) PCT Pub. No.: WO2008/043834

PCT Pub. Date: Apr. 17, 2008

(65) Prior Publication Data

US 2011/0183560 A1 Jul. 28, 2011

(30) Foreign Application Priority Data

Oct. 13, 2006 (DE) ..... 10 2006 049 033

(51) Int. Cl.
*D06P 5/00* (2006.01)

(52) U.S. Cl. ..... 8/467; 8/495; 8/497; 8/648

(58) Field of Classification Search ..... 8/467, 495, 8/497, 648
See application file for complete search history.

(56) References Cited

U.S. PATENT DOCUMENTS

2006/0030228 A1 2/2006 Truesdale, III

FOREIGN PATENT DOCUMENTS

| | | |
|---|---|---|
| CH | 681 600 | 4/1993 |
| DE | 103 61 063 | 7/2005 |
| EP | 1 477 076 | 11/2004 |
| WO | WO 00/60964 | 10/2000 |
| WO | WO 2005/061777 | 7/2005 |

OTHER PUBLICATIONS

English Abstract of the Patent No. WO 2005061777 A1, dated, Jul. 7, 2005.*
International Search Report, (Jan. 2008).

(Continued)

*Primary Examiner* — Eisa Elhilo
(74) *Attorney, Agent, or Firm* — Collard & Roe, P.C.

(57) ABSTRACT

The invention relates to a process for producing safety textiles in one of the following colors: fluorescent yellow, fluorescent orange-red or fluorescent red. In a first step a textile starting material is pre-dyed in the desired color such that the pre-dyed fluorescent material has a specified first minimum luminance factor and the color is situated within an associated color diamond. After that the pre-dyed material is cross-dyed with a mixture of a luminescent pigment dye and a binder in such a way that the cross-dyed fluorescent material has a specified second minimum luminance factor and the color of the cross-dyed material continues to be situated within the color diamond. Subsequently the cross-dyed material is dried.

22 Claims, 3 Drawing Sheets

OTHER PUBLICATIONS

Figure 1:
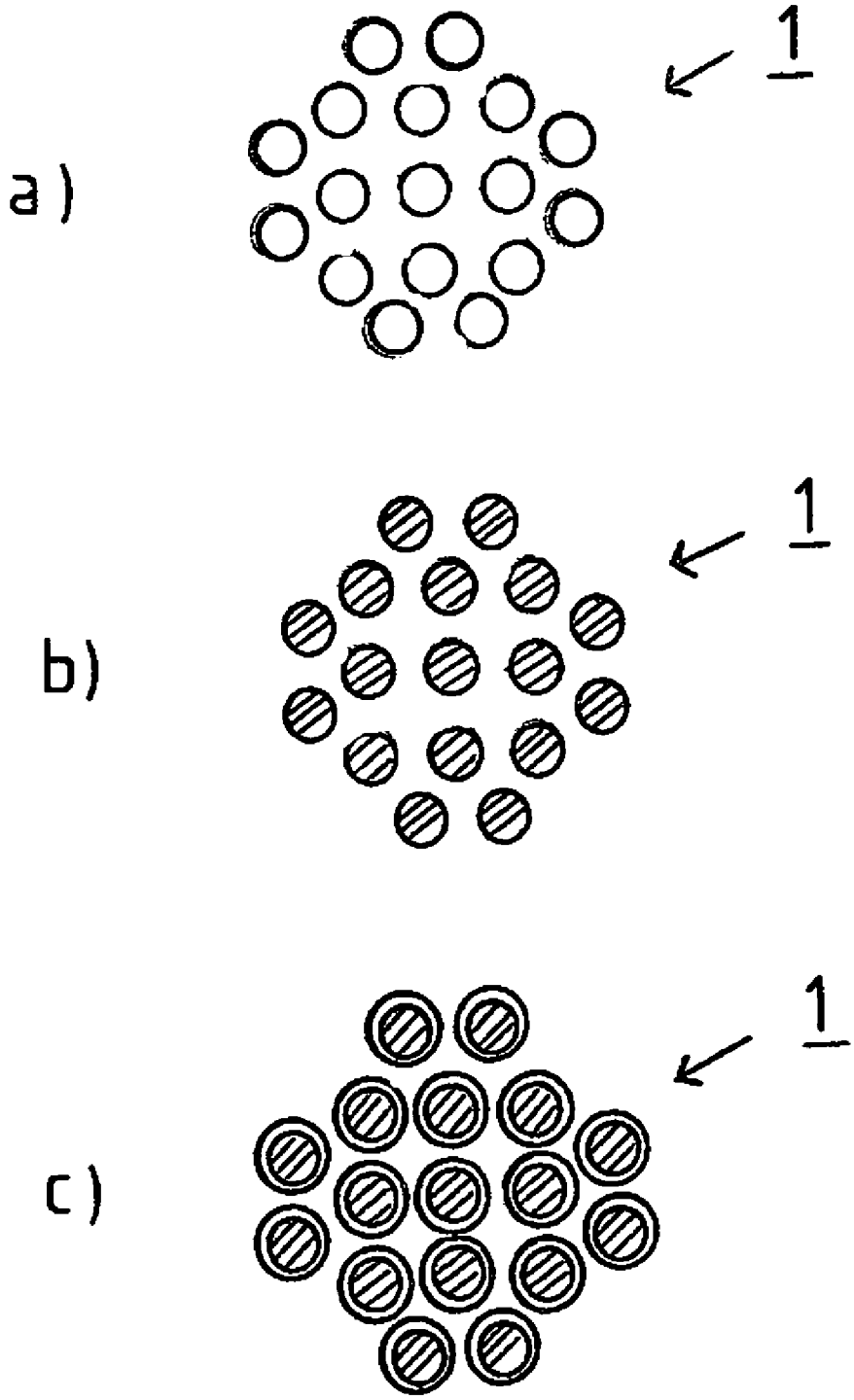

English translation of the International Preliminary Report on Patentability and Written Opinion of the International Searching Authority.
DIN EN 340, 2003. (Overview only) (Spec, pp. 1 and 4).
DIN EN 471, Dec. 2003. (With Overview) (Spec, pp. 1, 2, 4-6 and 8).
DIN EN 531, Sep. 1995. (With Overview) (Spec, pgs. 4 and 8-9).
DIN EN 533 (Overview only) (Spec, pp. 4 and 8-9).
DIN EN 1149 (Overview only).
DIN EN 1149-1 (Overview only) (Spec, pp. 4 and 9).
DIN Pr ENV 50354 (Overview only) (Spec, p. 10).
DIN EN 469, 2006. (Overview only).

* cited by examiner

METHOD OF PRODUCING SAFETY TEXTILES IN ONE OF THE COLORS FLUORESCENT YELLOW, ORANGE-RED AND FLUORESCENT RED

CROSS REFERENCE TO RELATED APPLICATIONS

This application is the National Stage of PCT/EP2007/060877 filed on Oct. 12, 2007, which claims priority under 35 U.S.C. §119 of German Application No. 10 2006 049 033.9 filed on Oct. 13, 2006. The international application under PCT article 21(2) was not published in English.

The invention relates to a method of producing safety textiles in one of the colours fluorescent yellow, fluorescent orange-red and fluorescent red.

Reflective safety vests fulfilling DIN standards EN 340 and EN 471 are already known. Safety vests of that kind have, for some time, had to be carried in motor vehicles. They are donned, in the case of a vehicle breakdown or in the case of an accident, by the vehicle occupants, who leave the vehicle for, for example, the purpose of changing a wheel, etc., so that the attention of drivers of following vehicles is drawn, already from a greater distance, to the fact that persons are standing on or in the vicinity of the roadway. Known reflective safety vests of that kind, which are present in the colour fluorescent orange-red, consist of polyester. In practice they can be used merely as warning vests. Further advantageous properties such as, for example, low flammability, particularly no hole formation, no molten dripping and a low afterglow time, are not possessed by warning vests of that kind consisting of polyester.

Moreover, a protective article of clothing having a flame-retardant material is known from DE 103 61 063 A1. The flame-retardant material comprises a textile surface structure with a coating of silicon material. The textile surface structure contains at least one low-flammability fibre material without fluorescent colour and includes intermediate spaces which are arranged to be distributed in the textile surface structure and which penetrate this in such a manner that air can pass through the textile surface structure. The textile surface structure is substantially completely coated with the silicon material, wherein, however, the silicon material does not completely fill the intermediate spaces in the surface structure. The silicon material constitutes a proportion of 40% to 75% with respect to the area weight of the material and contains luminescent pigments with a proportion of at most 30% referred to the amount of silicon material. The fibre material of low flammability can be aramide fibres.

The object of the invention consists in indicating a new method for producing safety textiles in one of the colours fluorescent yellow, fluorescent orange-red and fluorescent red, by means of which safety textiles with improved characteristics can be produced.

This object is fulfilled by a method with the features indicated in claim 1. Advantageous refinements and developments of the invention are evident from the dependent claims 2 to 21. Claim 22 relates to a safety textile which was produced in accordance with a method according any one of claims 1 to 21.

According to the present invention there is carried out, in a first step, a pre-colouring of the textile starting material which is preferably aramide, an aramide mixture, modacryl or a modacryl mixture. This pre-colouring is carried out in the desired colour and, in particular, in such a manner that the pre-coloured fluorescent material has a predetermined first minimum luminance factor and the colour of the pre-coloured fluorescent material lies within a colour lozenge, which is associated with the desired colour, with predetermined colour points. In that case the predetermined first minimum luminance factor is less than that minimum luminance factor predetermined in accordance with the safety standard EN 471 for this colour. The colour lozenge associated with the desired colour has, thereagainst, corner points which correspond with the corner points of the safety standard EN 471. This means that already in the pre-colouring it is noted that the pre-coloured material has a predetermined first minimum luminance factor and the colour location of the predetermined material prior to exposure fulfils the conditions of the safety standard EN 471.

In a following second step an over-colouring of the pre-coloured fluorescent material by a mixture of luminescent pigment dye of the desired colour and a binder is carried out in such a manner that the over-coloured fluorescent material has a predetermined second luminance factor and the colour of the pre-coloured fluorescent material lies within the lozenge associated with the desired colour. In that case the predetermined second minimum luminance factor is that minimum luminance factor which is predetermined in accordance with safety standard EN 471 for the respective colour. This means that, through the over-colouring, the minimum luminance factor has to be increased from the first minimum luminance factor to the second minimum luminance factor only comparatively slightly, for which purpose comparatively less luminescent pigments are necessary.

In a following third step, drying of the over-coloured material is carried out on a drying unit.

A further advantage of the method described in the foregoing consists that a possible detaching or abrasion of the mixture of dried luminescent pigment dye and binder is substantially invisible to the human eye, since the material present below the said mixture equally has the desired fluorescent colour, which lies within the associated colour lozenge.

Since—as was explained above—due to the pre-colouring carried out only comparatively little luminescent pigments are needed within the scope of the over-colouring, the proportion of binder referred to the area weight of the material can be kept relatively small. It preferably lies in a range of 1% to 20% referred to the area weight of the material. Particularly good results can be achieved if it lies in the range of 2% to 15%. In addition, the amount of luminescent pigments can be kept small. It preferably lies in the range of 5% to 20% referred to the area weight of the material.

In advantageous manner a pre-colouring of each individual fibre of the textile starting material takes place during the pre-colouring. This pre-colouring is carried out in, for example, the drawing-out method. In that case a bonding of the respective dye with the fibre material takes place so that the individual fibres are saturated with the dye. Moreover, during the over-colouring the employed mixture of luminescent pigment dye and binder, which can be a binder of a silicon-free polymer preparation, adheres to the outer circumference of each individual fibre. This adhesion of the mixture to the outer circumference of each individual fibre on the one hand requires only a small amount of space and keeps the air permeability of the over-coloured material high, since there is no coating of a yarn comprising a plurality of fibres. This in turn has the consequence that attention does not have to be given to leaving sufficient free space between adjacent yarns or fibres or filaments, etc., in order to be able to ensure the desired air permeability.

Figure 2:
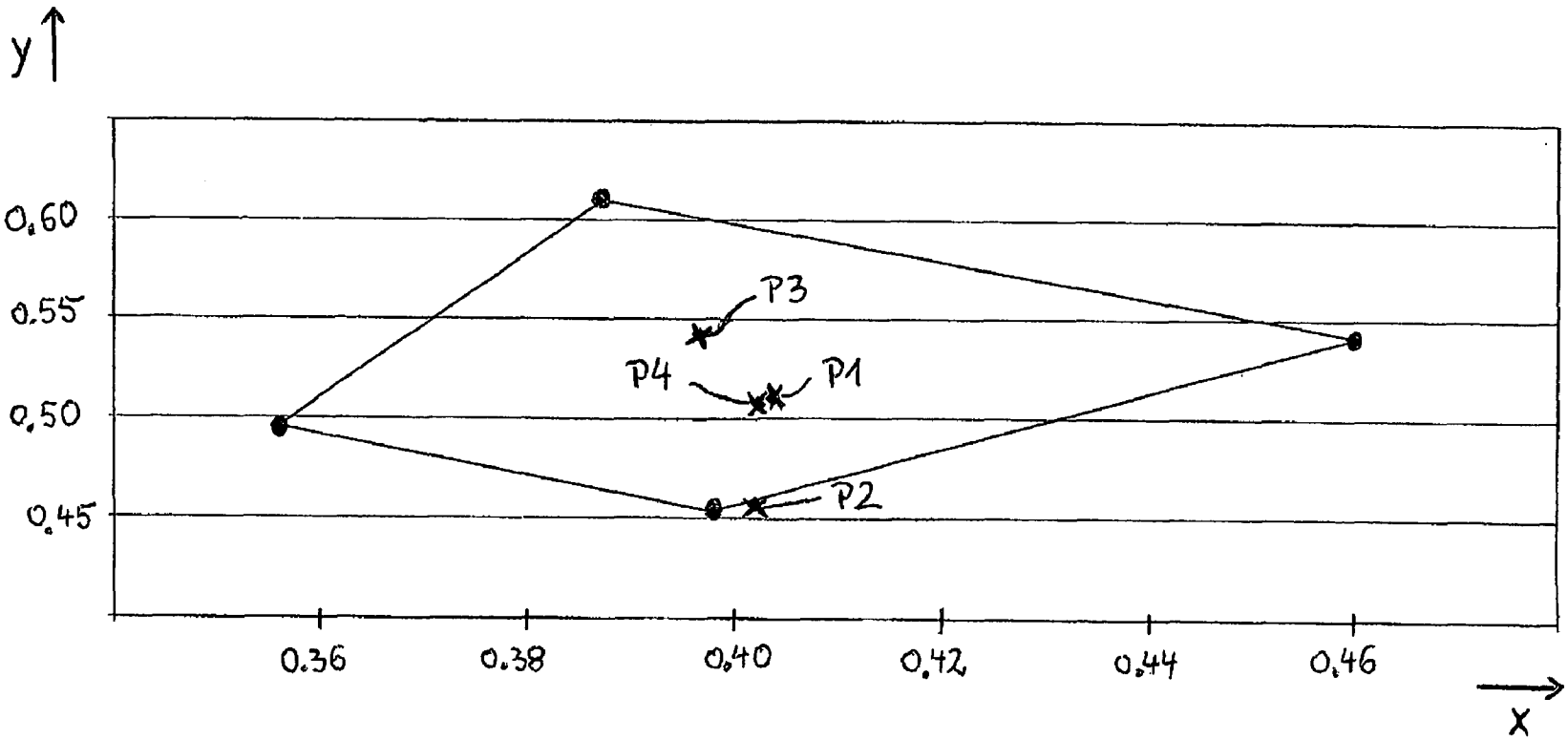
Figure 3:
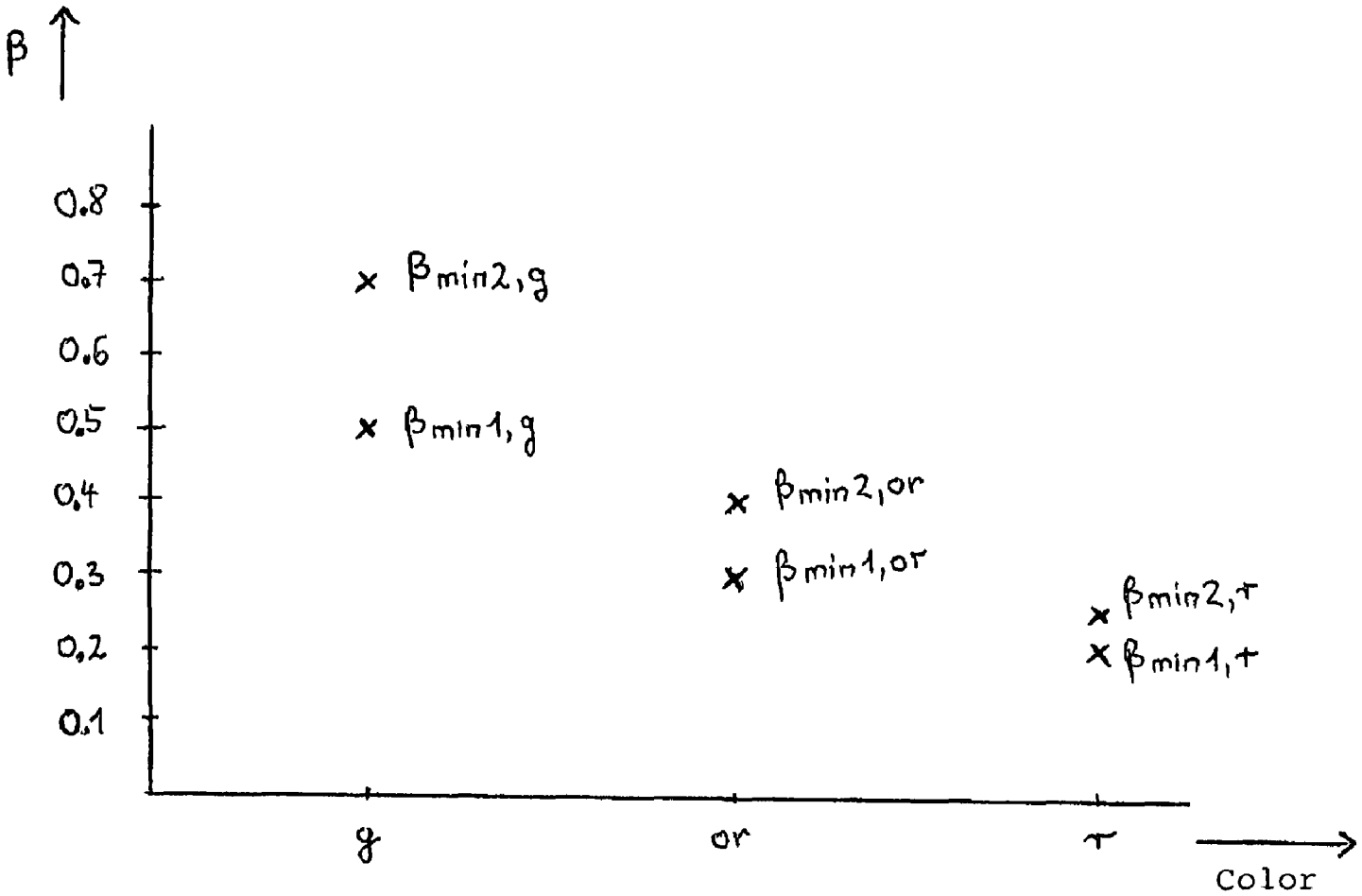

Further advantageous characteristics of the invention are evident from the following exemplifying explanation thereof by way of the figures, in which:

FIG. 1 shows sketches for explanation of the method according to the invention, FIG. 2 shows a diagram for clarification of the colour characteristics of the material processed in accordance with the method according to the invention and FIG. 3 shows a diagram for clarification of the brightness characteristics of the material processed in accordance with the method according to the invention.

According to the present invention safety textiles are produced which are present in one of the colours fluorescent yellow, fluorescent orange-red and fluorescent red. These safety textiles fulfil the prescriptions of the safety standards EN 340, EN 471, EN 531 and EN 533. Safety textiles according to advantageous developments of the invention also fulfil safety standards with higher demands, for example the safety standards EN 1149-1, EN 1149-2 and EN 1149-3.

The production of the safety materials according to the present invention takes place as follows:

Aramide, an aramide mixture, modacryl or a modacryl mixture is used as textile starting material. This starting material is present as a white fibre material and has flame retardant properties. The individual fibres form yarns, which form, for example, warp and weft threads of a woven material. Moreover, knitted ware or non-woven materials are possible.

This textile starting material is in a first step pre-coloured in the respectively desired colour, i.e. in fluorescent yellow, fluorescent orange-red or fluorescent red. This pre-colouring is carried out in, for example, the drawing-out method. In that case the pre-coloured textile starting material is introduced together with water, chemicals and the respective desired dye into a colouring apparatus or a colouring machine in which through the effect of temperature and time the dye enters into a bond with the fibre material or causes in or at the fibre material a physical and/or chemical bonding so that the fibre material adopts the desired colour. In that case attention is to be given to the pre-coloured fluorescent material having a predetermined first minimum luminance factor and the colour of the pre-coloured fluorescent material lying within a colour lozenge with predetermined corner points.

If the desired colour is fluorescent yellow, then the predetermined first minimum luminance factor is 0.5 and the predetermined corner points of the associated colour lozenge read as follows:

| x | y |
|---|---|
| 0.387 | 0.610 |
| 0.356 | 0.494 |
| 0.398 | 0.452 |
| 0.460 | 0.540 |

This predetermined first minimum luminance factor is lower than that minimum luminance factor which protective clothing in the colour fluorescent yellow have to have in accordance with the safety standard EN 471. The indicated colour lozenge corresponds, thereagainst, with that colour lozenge which is associated with protective clothing in the colour fluorescent yellow according to the safety standard EN 471.

If the desired colour is fluorescent orange-red, then the predetermined first minimum luminance factor is 0.3 and the predetermined corner points of the associated colour lozenge read as follows:

| x | y |
|---|---|
| 0.610 | 0.390 |
| 0.535 | 0.375 |
| 0.570 | 0.340 |
| 0.655 | 0.345 |

This predetermined first minimum luminance factor is less than that minimum luminance factor which protective clothing in the colour fluorescent orange-red has to have in accordance with the safety standard EN 471. The indicated colour lozenge, thereagainst, corresponds with that colour lozenge which is associated with the protective clothing in the colour fluorescent orange-red according to the safety standard EN 471.

If the desired colour is fluorescent red, then the predetermined first minimum luminance factor is 0.2 and the predetermined corner points of the associated colour lozenge read as follows:

| x | y |
|---|---|
| 0.610 | 0.390 |
| 0.535 | 0.375 |
| 0.595 | 0.315 |
| 0.690 | 0.310 |

This predetermined first minimum luminance factor is less than that minimum luminance factor which protective clothing in the colour fluorescent red has to have in accordance with the safety standard EN 471. The indicated colour lozenge, thereagainst, corresponds with that colour lozenge which is associated with the protective clothing in the colour fluorescent red according to the safety standard EN 471.

The pre-coloured fluorescent material is subsequently over-coloured by a mixture of the respectively desired luminescent pigment dye and a binder. A silicon-free polymer preparation which, as such, is almost transparent is used as binder. Examples of binders of that kind are polyacrylates and polyvinylacetates. The amount of required binder referred to the area weight of the pre-coloured fluorescent material lies in the range of 1% to 20%, preferably 2% to 15%. The amount of required luminescent pigment dye referred to the area weight of the material is, by virtue of the pre-colouring carried out, similarly comparatively small. It preferably lies in a range of 5% to 20%. The application of the said mixture to the pre-coloured fluorescent material is preferably carried out by a pad-dyeing. In this over-colouring a deposition or adhesion of the mixture of luminescent pigment dye and binder to the outer circumference of each individual fibre of the pre-coloured material takes place. Through this over-colouring the over-coloured fluorescent material has a predetermined second minimum luminance factor. The colour of the over-coloured fluorescent material lies within the same respective colour lozenge, which was already specified above, with the predetermined corner points. The predetermined second minimum luminance factor corresponds with that minimum luminance factor which is associated with the respective fluorescent colour according to the safety standard EN 471.

If the desired colour is fluorescent yellow, then the predetermined second minimum luminance factor is 0.7. If the desired colour is fluorescent orange-red, then the predetermined second minimum luminance factor is 0.4. If the desired colour is fluorescent red, then the predetermined second minimum luminance factor is 0.25.

After the over-colouring described in the foregoing a drying of the over-coloured material on a drying unit, for example on a tenter, is carried out in a further step.

An advantage of the method described in the foregoing consists in that the obtained end product remains respiration-active, since air permeability is given even between the individual over-coloured fibres. Attention does not have to be given to comparatively large air-permeable intermediate spaces being left between adjacent yarns, etc. The possible packing density of the over-coloured textile material can be high.

FIG. 1 shows sketches for explanation of the method according to the invention described in the foregoing. In that case a cross-sectional illustration of the textile starting material is shown in FIG. 1*a*, which material is in the form of individual fibres which are combined to form a yarn 1. The fibres are not coloured or are white.

FIG. 1*b* shows the pre-coloured textile material. It is indicated by the hatching of the individual fibres that the individual fibres within the scope of the pre-colouring are physically and/or chemically bonded by the respective dye or that the individual fibres have completely absorbed the dye. The pre-coloured textile material is already present in the desired colour and has a predetermined first minimum luminance factor.

FIG. 1*c* finally shows the over-coloured material. It is apparent that, in the over-colouring, the mixture of luminescent pigment dye and binder is deposited on the outer circumference of each individual fibre and adheres thereto. This adhesion is promoted by the fact that the individual fibres in practice do not have a smooth surface.

Since during pre-colouring the dye is completely absorbed by the fibre material and in the over-colouring only a deposition of a thin mixture film takes place, the spatial requirement of the colouring overall is small.

FIG. 2 shows a diagram for clarification of the colour characteristics of the material processed in the method according to the invention. Illustrated in FIG. 2 is the colour lozenge which is associated with the colour fluorescent yellow and the corner points of which have the following colour co-ordinates:

| x | y |
|---|---|
| 0.387 | 0.610 |
| 0.356 | 0.494 |
| 0.398 | 0.452 |
| 0.460 | 0.540 |

In addition, further points P1, P2, P3 and P4 are indicated in FIG. 2. The point P1 corresponds with the pre-coloured, not-yet exposed material, the point P2 corresponds with the pre-coloured and exposed material, the point P3 corresponds with the pre-coloured and over-coloured, not yet exposed material, and the point P4 corresponds with the pre-coloured and over-coloured and exposed material.

It is apparent that the points P1, P3 and P4 lie within the colour lozenge, but the point P2 does not. This means that the pre-coloured material, in particular, is already present within the colour lozenge, which corresponds with the colour fluorescent yellow, in the sense of the safety standard EN 471, but after exposure lies outside this lozenge. Since the safety standard EN 471 requires the material to also lie within the respective colour lozenge after exposure, the pre-coloured material does not fulfil the safety standard EN 471.

It is further apparent that the over-coloured material lies within the colour lozenge not only prior to exposure (point P3), but also after exposure (point P4). The over-coloured material consequently fulfils the safety standard EN 471.

FIG. 3 shows a diagram for clarification of the brightness characteristics of the material processed in the method according to the invention. In this diagram the colour is indicated on the abscissa and the luminance factors along the ordinate. It is evident from FIG. 3 that for the colour fluorescent yellow the minimum luminance factor $\beta$min1,y of the material required after the pre-colouring is 0.5 and the minimum luminance factor $\beta$min2,y required after the over-colouring is 0.7. In addition, it is apparent that for the colour fluorescent orange-red the minimum luminance factor $\beta$min1, o-r of the material required after the pre-colouring is 0.3 and the minimum luminance factor $\beta$min2,o-r required after the over-colouring is at 0.4. Furthermore, FIG. 3 shows that for the colour fluorescent red the minimum luminance factor $\beta$min1,r of the material required after the pre-colouring is 0.2 and the minimum luminance factor $\beta$min2,r required after the over-colouring is at 0.25.

By means of the method described in the foregoing it is possible moreover to produce safety textiles fulfilling the safety standards EN 471, EN 533 and EN 531.

Advantageous developments of the method according to the present invention are described in the following.

An alternative form of embodiment of the invention consists in carrying out the over-colouring of the pre-coloured material not by means of a continuous coating method such as pad-dyeing, but by means of a discontinuous application method.

A first advantageous development consists in adding an optical brightener to the mixture used for over-colouring. The luminance factor of the material can, if required, thereby be further increased.

A second advantageous development consists in adding a flame retardant to the mixture used for the over-colouring. This increases the security of keeping to the safety standards EN 531 and EN 533.

A third advantageous development consists in post-cleaning of the over-coloured material after drying and condensation out.

According to a fourth advantageous development the dried textile material can be added to an application bath and there subjected to an application with water repellent and/or dirt repellent effects, for example a hydrophobising, preferably a fluorocarbonising. In addition, a flame retardant can be added to this application bath for further increase in the security of keeping to the safety standards EN 531 and EN 533.

According to a fifth advantageous development the over-coloured textile material can be finished to have a low shrinkage character.

A sixth advantageous development consists in additionally working electrically conductive fibres, yarns or threads into the starting material. This has the advantage that the finally finished safety textiles have improved electrostatic properties and also fulfil the safety standards EN 1149-1, EN 1149-2 and EN 1149-3. This can, for example, be achieved by working metal fibres or carbon fibres into the starting material.

A seventh advantageous development consists in using, for example, a greater amount of aramide fibres per area as starting material. This development has the advantage that the finished safety textiles also fulfil the safety standard Pr ENV 50354. This relates to an extraneous light checking method for materials and small items for users who are exposed to the risk of stray arcs.

The invention claimed is:

1. Method of producing safety textiles in one of the colors fluorescent yellow, fluorescent orange-red and fluorescent red, by the following method steps:

pre-coloring a textile starting material of aramide, an aramide mixture, modacryl or a modacryl mixture in the desired color wherein the pre-colored fluorescent material has a predetermined minimum luminance factor and the color of the pre-colored fluorescent material lies within a color lozenge with predetermined corner points, over-coloring the pre-colored fluorescent material by a mixture of luminescent pigment dye of the desired color and a binder wherein the over-colored fluorescent material has a predetermined second minimum luminance factor and the color of the over-colored fluorescent material lies within the color lozenge with predetermined corner points and drying the over-colored material on a drying unit.

2. Method according to claim 1, wherein the desired color is fluorescent yellow, the predetermined first minimum luminance factor is equal to 0.5, the predetermined second minimum luminance factor is equal to 0.7 and the predetermined corner points of the color lozenge read as follows:

| x | y |
|---|---|
| 0.387 | 0.610 |
| 0.356 | 0.494 |
| 0.398 | 0.452 |
| 0.460 | 0.540. |

3. Method according to claim 1, wherein the desired color is fluorescent orange-red, the predetermined first minimum luminance factor is equal to 0.3, the predetermined second minimum luminance factor is equal to 0.4 and the predetermined corner points of the color lozenge read as follows:

| x | y |
|---|---|
| 0.610 | 0.390 |
| 0.535 | 0.375 |
| 0.570 | 0.340 |
| 0.655 | 0.345. |

4. Method according to claim 1, wherein the desired color is fluorescent red, the predetermined first minimum luminance factor is equal to 0.2, the predetermined second minimum luminance factor is equal to 0.25 and the predetermined corner points of the color lozenge read as follows:

| x | y |
|---|---|
| 0.610 | 0.390 |
| 0.535 | 0.375 |
| 0.595 | 0.315 |
| 0.690 | 0.310. |

5. Method according to claim 1, wherein in the pre-coloring the individual fibers of the textile starting material enter into a physical and/or chemical bond with the dye.

6. Method according to claim 1, wherein the binder is a silicon-free polymer preparation.

7. Method according to claim 1, wherein in the over-coloring the mixture of luminescent pigment and binder adheres to the outer circumference of each individual fiber of the pre-colored textile material.

8. Method according to claim 1, wherein a brightener is added in the over-coloring of the pre-colored textile material.

9. Method according to claim 1, wherein a flame retardant is added in the over-coloring of the pre-colored textile material.

10. Method according to claim 1, wherein the over-coloring of the pre-colored textile material is carried out by means of a discontinuous coating method.

11. Method according to claim 1, wherein the over-coloring of the pre-colored textile material is carried out by means of a continuous coating method.

12. Method according to claim 11, wherein the over-coloring of the pre-colored textile material is carried out by pad-dyeing.

13. Method according to claim 1, wherein the drying of the over-colored textile material is carried on a tenter.

14. Method according to claim 1, wherein the dried textile material is post-cleaned.

15. Method according to claim 1, wherein the dried textile material is fed to an application bath.

16. Method according to claim 15, wherein the textile material is provided in the application bath with a water-repelling surface.

17. Method according to claim 15, wherein the textile material is provided in the application bath with a dirt-repelling surface.

18. Method according to claim 15, wherein a flame retardant is added to the textile material in the application bath.

19. Method according to claim 1, wherein the textile material is finished to be low-shrinkage.

20. Method according to claim 1, wherein additional electrically conductive fibers, yarns or threads are worked into the starting material.

21. Method according to claim 1, wherein carbon fibers are worked into the starting material.

22. Safety textile which was produced in accordance with the method according to claim 1.

* * * * *